US010950218B2

(12) United States Patent
Togawa et al.

(10) Patent No.: US 10,950,218 B2
(45) Date of Patent: Mar. 16, 2021

(54) DRIVE SYSTEM AND ELECTRIC APPARATUS PROVIDED THEREWITH

(71) Applicant: Sony Interactive Entertainment Inc., Tokyo (JP)

(72) Inventors: Keiji Togawa, Tokyo (JP); Osamu Ota, Tokyo (JP); Takeshi Yamagishi, Kanagawa (JP)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 16/092,877

(22) PCT Filed: Apr. 19, 2016

(86) PCT No.: PCT/JP2016/062412
§ 371 (c)(1),
(2) Date: Oct. 11, 2018

(87) PCT Pub. No.: WO2017/183113
PCT Pub. Date: Oct. 26, 2017

(65) Prior Publication Data

US 2019/0130888 A1 May 2, 2019

(51) Int. Cl.
*G10K 11/178* (2006.01)

(52) U.S. Cl.
CPC .. *G10K 11/17873* (2018.01); *G10K 11/17857* (2018.01); *G10K 2210/3212* (2013.01)

(58) Field of Classification Search
None
See application file for complete search history.

(56) References Cited

U.S. PATENT DOCUMENTS

2008/0075294 A1 3/2008 Chatte
2012/0070012 A1 3/2012 Yoshizawa
2014/0239760 A1* 8/2014 Asai ..... H02K 7/116 310/83
2014/0341712 A1* 11/2014 Massini ..... F01N 1/065 415/119
2015/0223891 A1* 8/2015 Miller ..... A61B 5/1171 726/19

FOREIGN PATENT DOCUMENTS

CN 202673791 U 1/2013
JP 04350486 A 12/1992
(Continued)

OTHER PUBLICATIONS

International Preliminary Report on Patentability and Written Opinion for corresponding PCT Application No. PCT/JP2016/062412, 10 pages, dated Oct. 23, 2018.
(Continued)

*Primary Examiner* — Kenny H Truong
(74) *Attorney, Agent, or Firm* — Matthew B. Dernier, Esq.

(57) ABSTRACT

A drive system includes an actuator including an electric motor, a microphone, and a sound generator emitting a sound in response to a signal derived from sound caught by the microphone. The microphone is attached to the actuator. This drive system makes it easy to establish an optimal positional relationship between the microphone and the noise source in the actuator, thereby properly reducing noise arising from the actuator.

11 Claims, 6 Drawing Sheets

(56) References Cited

FOREIGN PATENT DOCUMENTS

| | | | |
|---|---|---|---|
| JP | 06209818 | A | 8/1994 |
| JP | 0954591 | A | 2/1997 |
| JP | 2002011679 | A | 1/2002 |
| JP | 2005171838 | A | 6/2005 |
| JP | 2011097677 | A | 5/2011 |

OTHER PUBLICATIONS

Extended Search Report for corresponding EP Application No. 16899387.1, 7 pages, dated Nov. 20, 2019.
International Search Report for corresponding PCT Application No. PCT/JP2016/062412,4 pages, dated Jun. 7, 2016.

* cited by examiner (a)

(b)

DRIVE SYSTEM AND ELECTRIC APPARATUS PROVIDED THEREWITH

TECHNICAL FIELD

The present invention relates to a drive system to be used for electric apparatuses such as robots, drones, and radio-controlled machines. More particularly, the present invention relates to a technology to reduce noise arising from an actuator in action.

BACKGROUND ART

There has been an active developmental work for robots imitating humans and animals. Such robots mostly employ an actuator driven by an electric motor as disclosed in JP 2002-11679A.

SUMMARY

Technical Problem

There is an instance where the actuator (particularly electric motor) in action gives forth a noise that annoys the user.

There is known active noise control as a technology for noise reduction. The active noise control achieves noise reduction by means of a microphone that picks up sounds including noise and a speaker that produces a sound in opposite phase with noise so that the sound from the speaker is superimposed on the noise picked up by the microphone. The active noise control is deeply affected by the positional relationship of the microphone relative to the noise source. Since any robot employs more than one actuator, it is difficult to optimize the positional relationship between the microphone and the noise source in all the actuators. For example, there will be an instance where the microphone is excessively far away from the noise source in the actuators.

It is an object of the present invention to provide a drive system and an electric apparatus provided therewith, the drive system having an actuator with an adequately low noise level.

Solution to Problem

The drive system for solution to the above problem includes an actuator including at least an electric motor, a microphone, and a sound generator emitting a sound in response to a signal derived from sound caught by the microphone. The microphone is attached to the actuator. This drive system makes it easy to establish an optimal positional relation between the microphone and the source of noise arising from the actuator. The drive system properly reduces noise arising from the actuator.

The electric apparatus for solution to the above problem is provided with more than one of the foregoing drive system. This electric apparatus makes it easy to establish an optimal positional relation between the microphone and the source of noise arising from the actuator. The electric apparatus properly reduces noise arising from the actuator.

DESCRIPTION OF EMBODIMENT

Figure 1:
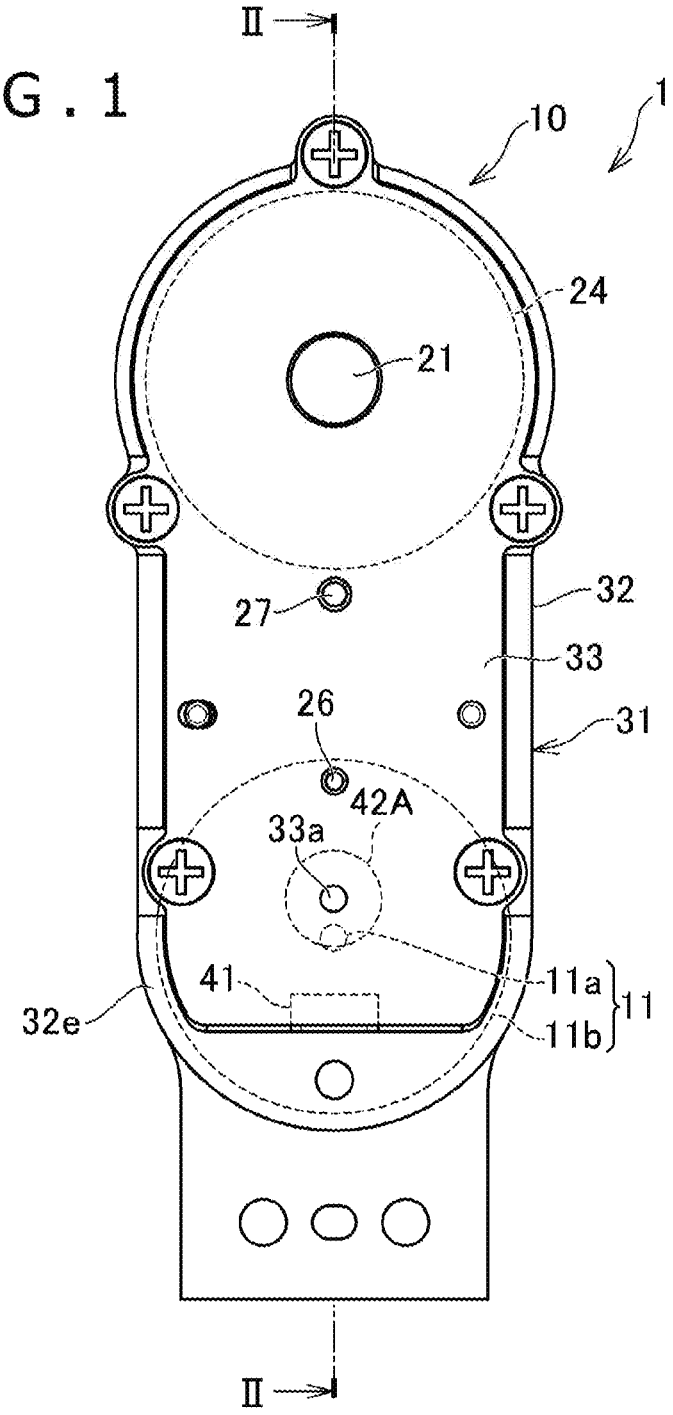
FIG. 1 is a perspective view depicting an actuator which is included in a drive system according to one embodiment of the present invention.
Figure 2:
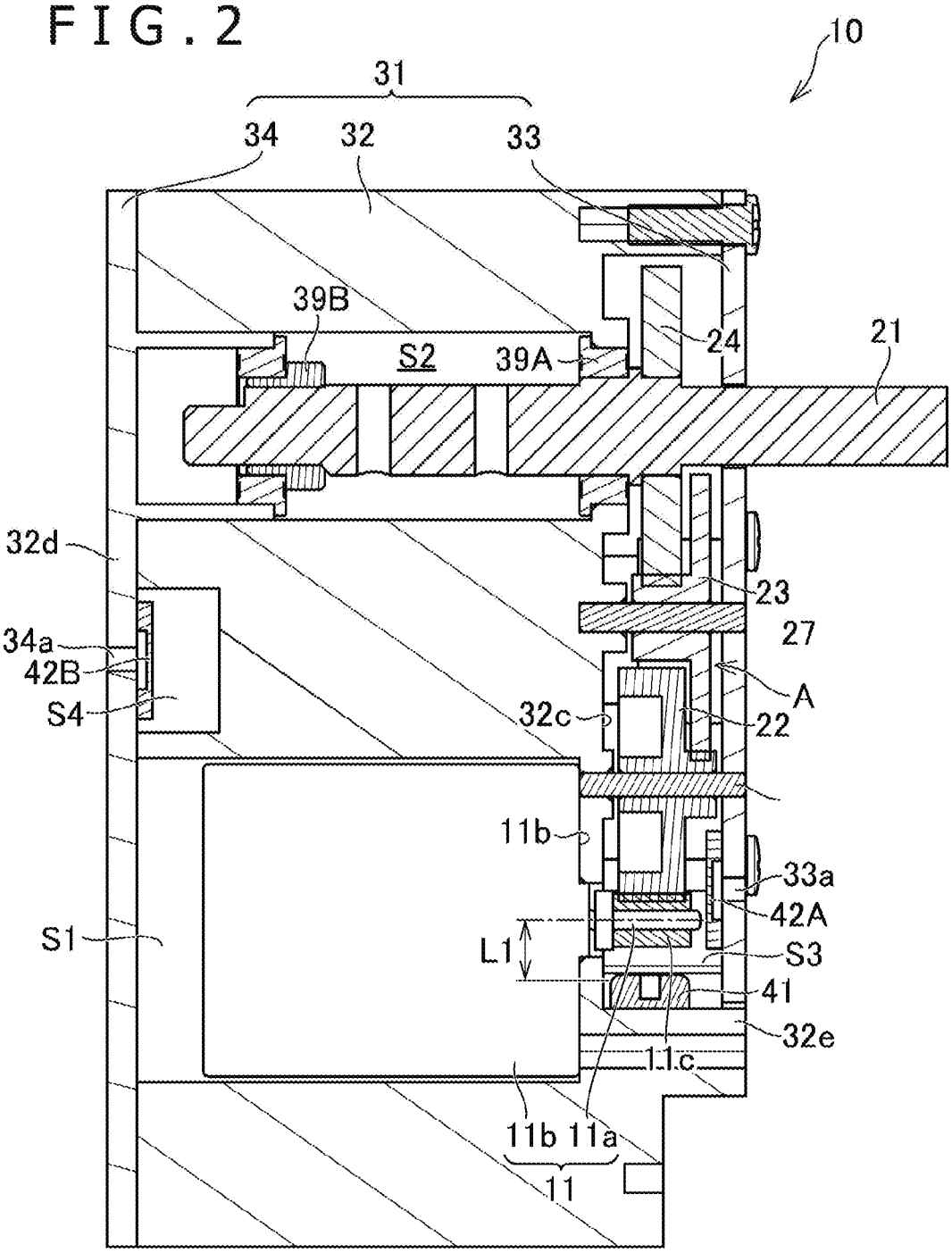
FIG. 2 is a sectional view taken along line II-II in FIG. 1.
Figure 3:
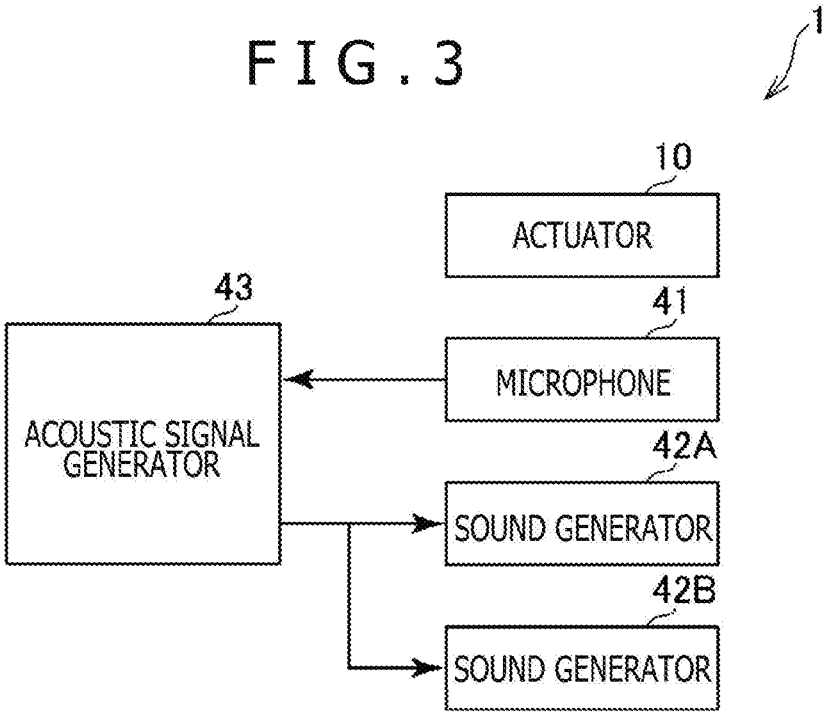
FIG. 3 is a block diagram depicting a structure of the drive system.

The following is a description of one embodiment according to the present invention. FIG. 1 is a front view depicting an actuator 10 which is included in a drive system 1 as an example of the embodiment of the present invention. FIG. 2 is a sectional view depicting the actuator 10 included in the drive system 1, which is a sectional view taken along line II-II in FIG. 1. FIG. 3 is a block diagram depicting a structure of the drive system 1.

The drive system 1 includes the actuator 10. As depicted in FIG. 2, the actuator 10 includes an electric motor 11 and an output shaft 21 which receives power from the electric motor 11. The output shaft 21 partly projects from a holder 31 mentioned later, and the projecting part connects to an external mechanism (such as the robot's arms). The electric motor 11 includes a motor body 11*b* which includes coils and magnets, and a rotating shaft 11*a* which projects from an end face 11*d* of the motor body 11*b*. In the example of the actuator 10, the rotating shaft 11*a* of the electric motor 11 and the output shaft 21 are arranged parallel to each other. This arrangement of the electric motor 11 and the output shaft 21 is not limited to the example of the actuator 10 and may be variously modified in such a way that the output shaft 21 intersects with the rotating shaft 11*a* obliquely or at right angles. Moreover, the output shaft 21 does not necessarily have a part projecting from the holder 31, in which case the output shaft 21 connects to the external mechanism through an opening made through a holder body 32.

The actuator 10 includes a mechanism A to transmit rotary force from the electric motor 11 to the output shaft 21. The mechanism A in the example of the actuator 10 is a reduction mechanism which reduces the rotating speed of the electric motor 11 and transmits the power to the output shaft 21. The reduction mechanism A includes a plurality of gears 22, 23, and 24. A gear 11*c*, which is attached to the rotating shaft 11*a* of the electric motor 11, engages with the first gear 22, thereby transmitting the rotary power of the gear 11*c* to the first gear 22 at a reduced rotating speed. The first gear 22 engages with the second gear 23 for power transmission at a reduced rotating speed. The second gear 23 engages with the third gear 24 for power transmission at a reduced rotating speed. The third gear 24 is fixed to the output shaft 21 so that it rotates together with the output shaft 21. The gears 22 and 23 are supported by intermediate shafts 26 and 27, respectively.

The reduction mechanism A is not restricted to the actuator 10 exemplified above. For example, the gear 24 attached to the output shaft 21 may engage directly with the gear 11*c* attached to the rotating shaft 11*a* of the electric motor 11. In another example, the reduction mechanism A may include a chain or belt. In further another example, the mechanism A does not necessarily have a function to reduce the rotating speed of the electric motor 11.

The actuator 10 includes the holder 31 supporting the electric motor 11 and the output shaft 21 thereof. The holder 31 of the actuator 10 exemplified above includes the holder body 32 for the electric motor 11 and the output shaft 21 thereof, and side plates 33 and 34 attached to the holder body 32. The holder body 32 has a space S1 to hold therein the motor body 11*b* of the electric motor 11. The holder body 32 also has a space S2 to hold therein the base of the output shaft 21 which is rotatably held by bearings 39A and 39B.

The holder 31 has a space S3 in which are arranged the reduction mechanism A and the rotating shaft 11*a* of the electric motor 11. In the example of the actuator 10, the rotating shaft 11*a* of the electric motor 11 and the output shaft 21 protrude from an end face 32*c* of the holder body 32. The reduction mechanism A is arranged along the end face 32*c* of the holder body 32. The side plate 33 mentioned above is so attached to the holder body 32 as to cover the rotating shaft 11*a*, the output shaft 21, and the reduction mechanism A. The side plate 33 also defines the holder body 32 and the space S3. As mentioned above, in the example of the actuator 10 depicted in FIG. 1, the holder 31 functions as a case to hold the whole of the electric motor 11 and the reduction mechanism A.

In the example of the actuator 10, the holder body 32 has the spaces S1 and S2 formed therein which open opposite to the end face 32*c* of the holder body 32. The side plate 34 mentioned above is so attached to the holder body 32 as to cover an end face 32*d* opposite to the end face 32*c* of the holder body 32.

The holder 31 may be constructed differently from that of the actuator 10 illustrated above. For example, the holder 31 may be constructed of two members which form, when combined together, a space to hold therein the electric motor 11, the reduction mechanism A, and the output shaft 21 (each half of the space will be called the holder half hereinafter). Thus, the holder 31 may be constructed of two holder halves which can be separated by a plane including the center line of the rotating shaft 11*a* of the electric motor 11 and the center line of the output shaft 21 or by a plane perpendicular to the center line of the rotating shaft 11*a*. In this instance, the holder 31 may not have the side plates 33 and 34, in which case the output shaft 21 may be supported by two bearings which are oppositely positioned to hold the gear 24 between them. This structure does not need the space S2 and the bearing 39B.

There is another instance which does not always need the holder 31 to house the electric motor 11. In other words, the holder 31 may be constructed such that the electric motor 11 or the reduction mechanism A is partly exposed.

The drive system 1 includes a microphone 41, sound generators 42A and 42B, and an acoustic signal generator 43 (see FIG. 3). The microphone 41 is attached to the actuator 10 to be mentioned later, so that it picks up surrounding sounds. The surrounding sounds caught through the microphone 41 include noise emanating from the actuator 10. In other words, the microphone 41 picks up the sounds that occur as a result of movement of movable parts including the rotating shaft 11*a* of the electric motor 11, the reduction mechanism A, and the output shaft 21. The sounds caught by the microphone 41 are converted into electric signals which are subsequently output to the acoustic signal generator 43.

The acoustic signal generator 43 executes processing associated with active noise control. In other words, the acoustic signal generator 43 utilizes the sounds caught by the microphone 41 so as to generate a signal of the sound to reduce the level of noise spreading outward, the sound being superimposed on the noise of the actuator 10. For example, the acoustic signal generator 43 receives signals from the microphone 41 and picks up from them the acoustic signals including noise arising from the movable part of the actuator 10. Then, the acoustic signal generator 43, for example, reverses the phase of the acoustic signal acquired from the microphone 41 and outputs the resulting signal to the sound generators 42A and 42B. The foregoing procedure may be changed as follows. The acoustic signal generator 43 screens the sounds caught by the microphone 41 and detects in them a sound of prescribed frequency (preferably the sound containing noise arising from movable parts) and outputs the acoustic signal corresponding to the thus detected sound.

The microphone 41 is attached to the actuator 10, as depicted in FIG. 2. To be specific, the microphone 41 is attached to the holder 31 in the example of the actuator 10. This structure helps minimize the distance from the microphone 41 to a noise source in the actuator (that is, the movable part of the actuator 10). Adhesive or a fixing tool such as screws may be used to fix the microphone 41.

In the example of the actuator 10 depicted in FIG. 2, the microphone 41 is placed in the holder 31. In other words, the microphone 41 is placed in the space S3 that holds the movable part of the actuator 10. This arrangement permits the microphone 41 to easily pick up noise arising from the movable part. The space S3 is a closed space demarcated by the holder body 32 and the side plate 33. This allows the microphone 41 to pick up only the sound excluding ambient noises. The placement of the microphone 41 is not restricted to that in the example of the actuator 10. For example, the microphone 41 may be placed in a specially made room in the holder 31.

The actuator 10 is provided with the reduction mechanism A which has several movable parts including the rotating shaft 11*a* of the electric motor 11 and the gear 11*c* which run very fast. Therefore, the rotating shaft 11*a* of the electric motor 11 and the gear 11*c* are quite likely to produce noises. This is the reason why the microphone 41 is placed in the neighborhood of the rotating shaft 11*a* in the example of the actuator 10. The distance L1 (see FIG. 2) between the microphone 41 and the rotating shaft 11*a* should preferably be equal to or less than 2 cm. More preferably, the distance between the microphone 41 and the rotating shaft 11*a* should be equal to or less than 1 cm. Further preferably, the distance between the microphone 41 and the rotating shaft 11*a* should be equal to or less than 0.5 cm.

In the example of the actuator 10 depicted in FIG. 2, the microphone 41 is located somewhere away from the rotating shaft 11*a* of the electric motor 11 in its radial direction. Moreover, the microphone 41 opposes to the reduction mechanism A, with the rotating shaft 11*a* held inbetween. There are no other members than the gear 11*c* of the rotating shaft 11*a* between the microphone 41 and the rotating shaft 11*a*. This arrangement allows the microphone 41 to pick up more adequately the sound including noises due to revolution of the rotating shaft 11*a* and the gear 11*c*.

In the example of the actuator 10, the microphone 41 is attached to the holder body 32. In other words, the holder body 32 has a wall 32*e* lying on the line extending from the rotating shaft 11*a* in its radial direction, and the microphone 41 is attached to the inner surface of the wall 32*e*.

As mentioned above, the drive system 1 has the acoustic signal generator 43, which is composed of integrated circuits. The substrate carrying the integrated circuits is placed outside the holder 31. In other words, the substrate for the integrated circuits is placed in the space which is outside the holder 31 and surrounded by the external member of the electric apparatus carrying the drive system 1.

As mentioned above, the drive system 1 is provided with the sound generators 42A and 42B, which receive the signals generated by the acoustic signal generator 43 and emit sounds corresponding to the received signals. Each of the sound generators 42A and 42B is a speaker including a diaphragm or a voice coil. Alternatively, the sound generators 42A and 42B may include the voice coil but may not include the diaphragm. In this case, the voice coil may produce sounds by vibrating a thin plate member (such as cover) as part of the actuator 10.

In the example of the drive system 1, the sound generators 42A and 42B are attached to the actuator 10. In other words, the sound generators 42A and 42B are attached to the holder 31. This arrangement is useful in the case where more than one unit of the actuator 10 are mounted on one apparatus, because the sound arising from the sound generators 42A and 42B of one actuator 10 is free from interference with the sound arising from the other actuators 10.

As depicted in FIG. 2, the actuator 10 is provided with a plurality of sound generators 42A and 42B. In the example of the drive system 1, the actuator 10 is provided with two sound generators 42A and 42B. The sound generators 42A and 42B are arranged such that they emit sounds in different directions. In other words, the two sound generators 42A and 42B face opposite each other and emit sounds in the opposite directions. The directions in which the two sound generators 42A and 42B emit sounds are not restricted to those exemplified for the actuator 10. The two sound generators 42A and 42B may be arranged such that they emit sounds in the mutually crossing two directions.

The number of the sound generators attached to the actuator 10 is not restricted to two. For example, one sound generator may be attached to the actuator 10 or three or more sound generators may be attached to the actuator 10. There may be an instance in which the drive system 1 has part of the sound generators attached to the actuator 10 and another part of the sound generators not attached to the actuator 10.

The sound generator 42A is arranged in the space S3 which holds the movable parts (the rotating shaft 11*a* and the reduction mechanism A) of the actuator 10, as in the case of the microphone 41. In the example of the actuator 10, the sound generator 42A is arranged near the rotating shaft 11*a* of the electric motor 11, in the same way as the microphone 41. In other words, the sound generator 42A is positioned in the axial direction of the rotating shaft 11*a* of the electric motor 11, and no other members exist between the sound generator 42A and the rotating shaft 11*a*.

The sound generator 42A is arranged in the space S3 such that it faces toward the outside of the holder 31. The sound generator 42A in the example of the actuator 10 is attached to the inner surface of the space S3 (or the inner surface of the side plate 33). The side plate 33 has a through hole 33*a* formed therein. The sound generator 42A is attached so as to face this through hole 33*a*. This arrangement permits the sound generator 42A to effectively emit sounds outward from the holder 31. The through hole 33*a* in the side plate 33 is not necessarily essential. The sound generator 42A may be fixed with adhesive or a fixing tool such as screws.

The sound generator 42B is also attached to the actuator 10. In the example of the drive system 1 depicted in FIG. 2, the holder body 32 includes a space S4 opposite to the space S3. The space S4 opens in the direction opposite to the direction in which the sound generator 42A emits sounds. The sound generator 42B is arranged in the space S4 and fixed to the inner surface of the space S4. In the example of the actuator 10, the side plate 34 is attached to the holder body 32 in such a way as to cover the opening of the space S4. The sound generator 42B is attached to the inner surface of the side plate 34 so that it faces outward from the holder 31.

The sound generator 42B is fixed toward a through hole 34*a* which is formed in the side plate 34. This structure permits the sound generator 42B to effectively emit sounds outward from the holder 31. The through hole 34*a* in the side plate 34 is not necessarily essential. The sound generator 42A may be fixed with adhesive or a fixing tool such as screws.

The holder 31 may have the side plates 33 and 34 omitted therefrom as mentioned above. In this case, the holder 31 may include two holder halves thereof which form, when combined together, the spaces S1, S2, and S3, and the sound generators 42A and 42B are attached to the inner surface of the holder halves (inner surface of the spaces). Alternatively, the sound generators 42A and 42B may be fixed toward the through hole formed in the holder halves.

Figure 4:
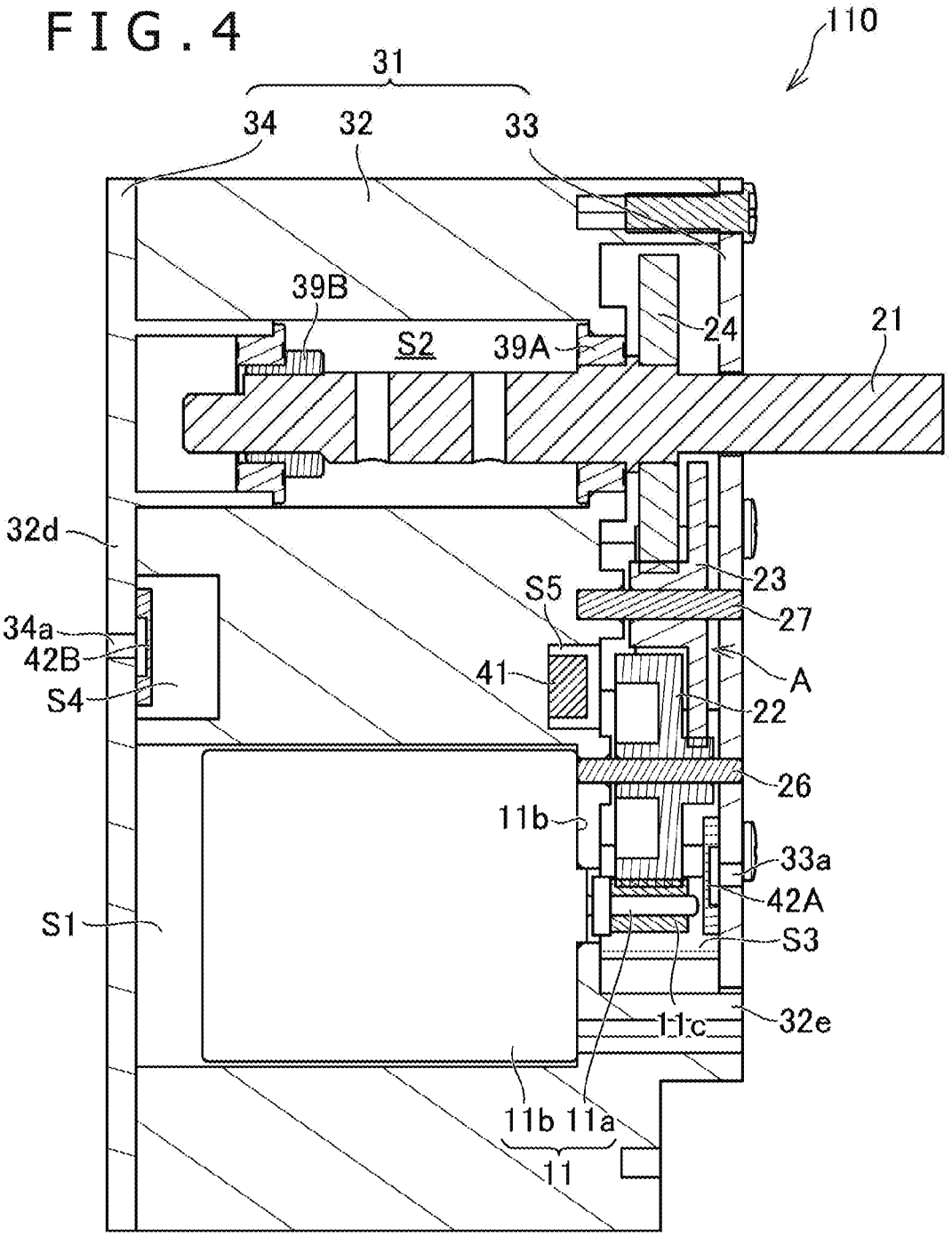
FIG. 4 is a sectional view depicting a modified example of the actuator.

The microphone 41 and the sound generators 42A and 42B may be arranged in any way without being restricted as exemplified for the actuator 10. FIG. 4 depicts a modified example of the actuator 10, with identical parts with those described above indicated by identical signs.

The actuator 10 may be constructed in any other way than that depicted in FIGS. 1 and 2. That is, the actuator 10 may be modified as depicted in FIG. 4. An actuator 110 depicted in FIG. 4 has the holder 31 which includes a space S5 to hold therein the microphone 41. To be more specific, the space S5 is formed in the holder body 32, and the space S5 opens toward the space S3 in which are arranged the movable parts (the rotating shaft 11*a* and the reduction mechanism A) of the actuator 110. In other words, the space S5 and the space S3 are joined together. The microphone 41 in the space S5 is able to adequately pick up sounds containing noise from the movable parts. Incidentally, those parts depicted in FIG. 4 which are identical with those parts depicted in FIGS. 1 and 2 are given the identical signs.

There is another example in which the microphone 41 is attached to the side plate 33 instead of the holder body 32. In this case, the microphone 41 may be so arranged as to face the movable part of the actuator 10.

There is further another example in which the microphone 41 is attached to the electric motor 11. That is, the microphone 41 may be attached to the end face 11*d* of the motor body 11*b* from which the rotating shaft 11*a* protrudes.

There is further another example in which the microphone 41 is placed at the position that overlaps or covers the sound generator 42A. In other words, the microphone 41 may be attached to the sound generator 42A directly or indirectly through another member.

The sound generators 42A and 42B may also be attached to the outer surface of the holder 31. For example, the sound generators 42A and 42B may be attached to the outer surface of the side plates 33 and 34.

Figure 5:
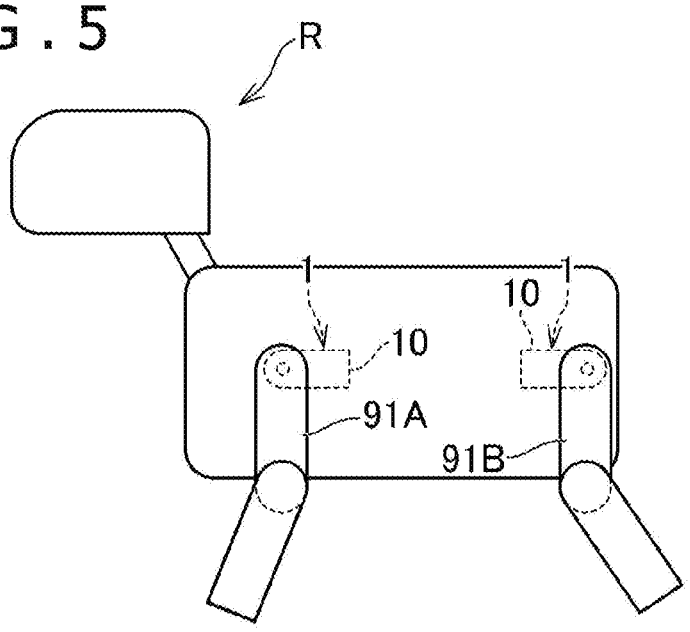
FIG. 5 is a diagram depicting a robot (as an electric apparatus) equipped with the drive system.

There may exist an example in which more than one unit of the drive system 1 control one unit of the electric apparatus and each of the plurality of actuators 10 is provided with the microphone 41 and the sound generators 42A and 42B mentioned above. FIG. 5 schematically depicts a robot R as an example of such an electric apparatus. The illustrated robot R looks like a dog.

The robot R is provided with the arms 91A and 91B. The robot R also has more than one unit of the actuator 10 to move the arms 91A and 91B. In other words, the robot R has more than one unit of the drive system 1. Each unit of the drive system 1 has the actuator 10, and each unit of the actuator 10 is provided with the microphone 41 and the sound generators 42A and 42B mentioned above. The actuator 10 has its output shaft 21 connected to the base of each of the arms 91A and 91B, so that the actuator 10 drives the arms 91A and 91B. All units of the drive system 1 may be connected to the acoustic signal generator (integrated circuit) 43 to be shared among them.

Figure 6:
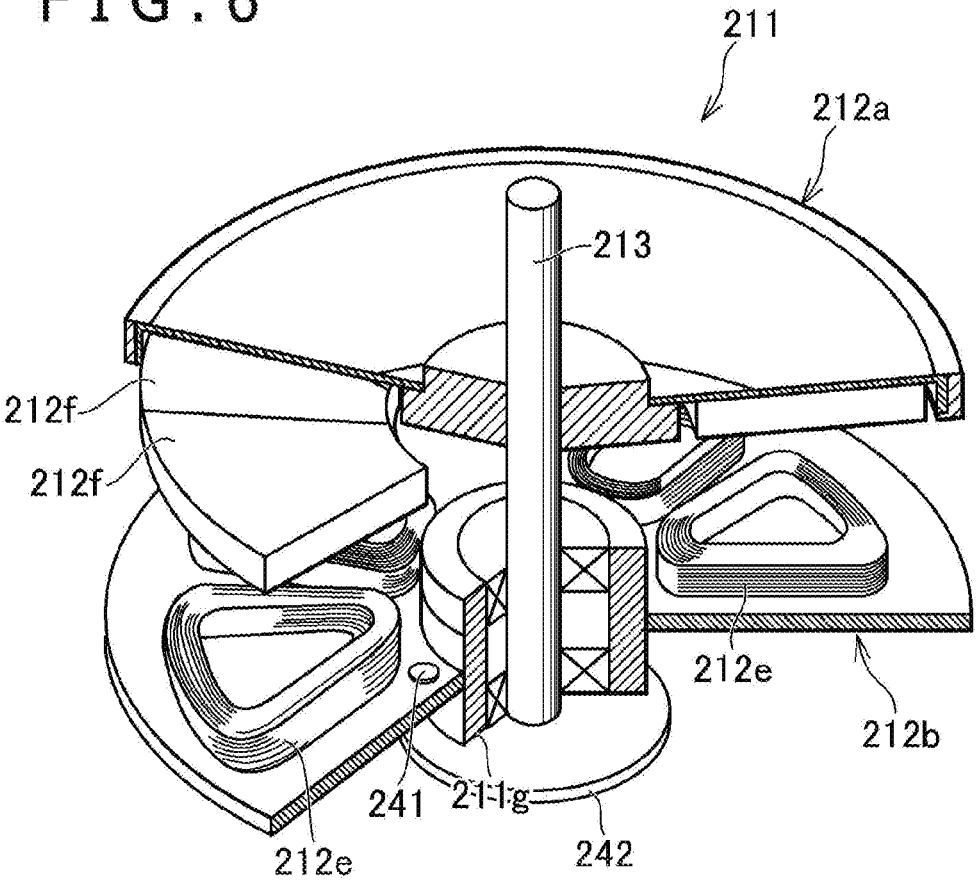
FIG. 6 is a diagram depicting an actuator included in the drive system according to a modified example.

FIG. 6 is a diagram depicting an actuator included in the drive system 1 according to a modified example. In the figure, an electric motor 211 is depicted as the actuator according to the modified example.

The electric motor 211 includes a motor body 212 that has a rotor 212*a* and a stator 212*b*, and a rotating shaft (or output shaft) 213 which rotates integrally with the rotor 212*a*. The drive system explained here differs from the drive system 1 explained above in that it does not have the reduction mechanism A and the holder 31. Consequently, the rotating shaft 213 is connected directly to the external mechanism. The stator 212*b* is provided with a coil 212*e*, and the rotor 212*a* is provided with a magnet 212*f*. In the example of FIG. 6, the rotor 212*a* and the stator 212*b* are arranged opposite each other in the axial direction of the rotating shaft 213.

The drive system has a microphone 241, which picks up sounds containing noise that arises as the electric motor 211 operates. The microphone 241 is located inside the motor body 212, or the microphone 241 is located between the stator 212*b* and the rotor 212*a*. This arrangement shortens the distance between the microphone 241 and the rotating shaft 213, thereby allowing the microphone 241 to effectively pick up sounds containing noise that arises from the rotating shaft 213 in action. The microphone 241 is located somewhere away from the rotating shaft 213 in its radial direction.

The stator 212*b* has a surface opposite to the rotor 212*a*, which supports thereon a plurality of coils 212*e* surrounding the rotating shaft 213. The microphone 241 is placed inside the array of the coils 212*e*. In other words, the microphone 241 is placed between the coil 212*e* and the rotating shaft 213. The placement of the microphone 241 is not restricted to that depicted in FIG. 6; the microphone 241 may be placed inside one of the coils 212*e*, for example.

The drive system which has the electric motor 211 as the actuator also has the above-mentioned acoustic signal generator 43 (see FIG. 3). The electric motor 211 is provided with a sound generator 242. The sound generator 242 emits sounds which are generated in response to signals from the acoustic signal generator 43, that is, acoustic signals generated on the basis of sounds received through the microphone 241. Incidentally, the sound generator 242 is attached to a bottom 211*g* of the electric motor 211, and it is exposed outward from the electric motor 211.

The placement of the microphone 241 and the sound generator 242 is not restricted to the one depicted in FIG. 6. For example, both the microphone 241 and the sound generator 242 are attached on the outside of the electric motor 211. For example, both the microphone 241 and the sound generator 242 are attached to the bottom 211*g* of the electric motor 211.

Figure 7:
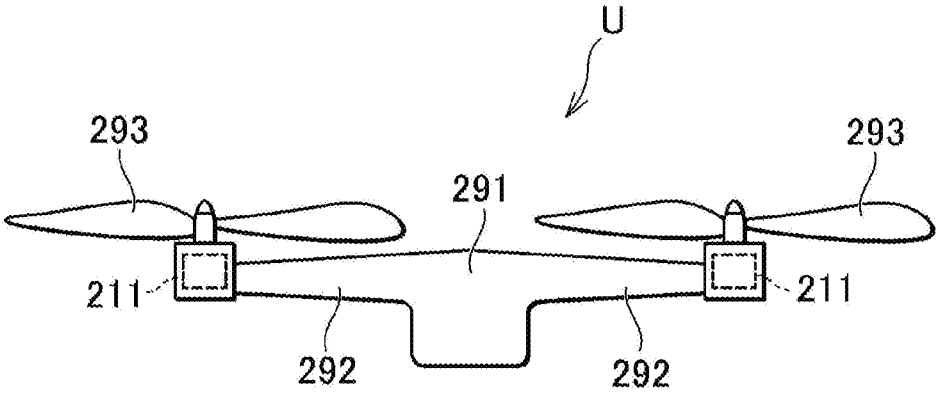
FIG. 7 is a diagram depicting a drone (as an electric apparatus) equipped with the actuator depicted in FIG. 6.
Figure 7:
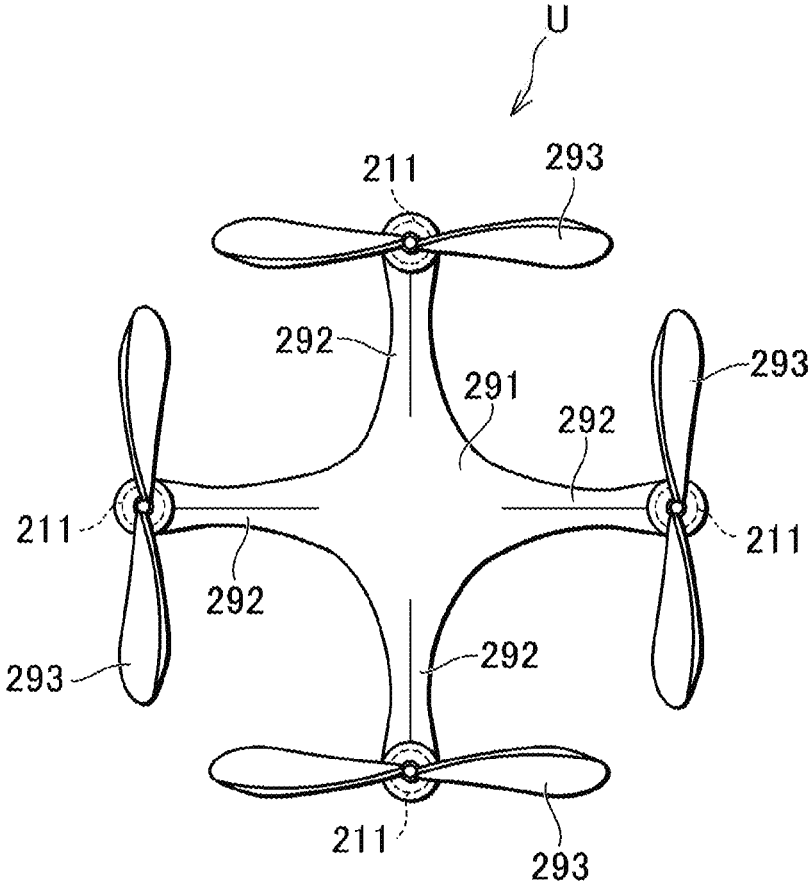

FIG. 7 is a diagram depicting an example of an electric apparatus carrying the drive system which was explained above with reference to FIG. 6. The illustrated electric apparatus is a drone U, whose side view and plan view are FIG. 7(*a*) and FIG. 7(*b*), respectively. The drone U has more than one (or four) drive systems. Each drive system carries the electric motor 211. These drive systems may have the acoustic signal generator (integrated circuit) to be shared among them.

The drone U has four arms 292 extending from its center 291, and each arm 292 has the electric motor 211 at its end. Each electric motor 211 included in the drone U carries the microphone 241 and the sound generator 242, which have been mentioned above. The drone U has a propeller 293 at an end of each of the arms 292, and the propeller 293 is attached to the rotating shaft 213 of the electric motor 211.

The invention claimed is:

1. A drive system comprising:

an actuator including at least an electric motor, which includes a motor body and a rotating shaft having an external portion extending from the motor body, where a central axis of the electric motor extends coaxially along the rotating shaft, and where an exterior surface of the motor body is at a first radial distance from the central axis;

a microphone operating to pick up sound emitted from the electric motor, where the microphone is located radially from the external portion of the rotating shaft at a second radial distance less than the first radial distance; and sound generator emitting a sound in response to a signal derived from the sound caught by the microphone.

2. The drive system according to claim 1, wherein the actuator includes the electric motor, an output shaft driven by the electric motor, and a holder carrying the electric motor and the output shaft, and the microphone is attached to the holder.

3. The drive system according to claim 1, wherein the actuator includes the electric motor, an output shaft driven by the electric motor, and a holder carrying the electric motor and the output shaft, and the microphone is placed inside the holder.

4. The drive system according to claim 1, wherein the actuator has a movable part which includes a rotating shaft of the electric motor and an output shaft driven by the electric motor, and the microphone is placed in a space in which the movable part is placed.

5. The drive system according to claim 1, wherein the microphone is attached near a rotating shaft of the electric motor.

6. The drive system according to claim 5, wherein the microphone is positioned within a range of equal to or less than 2 cm from the rotating shaft of the electric motor.

7. The drive system according to claim 1, wherein the sound generator is attached to the actuator.

8. The drive system according to claim 1, wherein the actuator includes the electric motor, an output shaft driven by the electric motor, and a holder carrying the electric motor and the output shaft, and the sound generator is attached to the holder.

9. The drive system according to claim 1, wherein the electric motor has a motor body and a rotating shaft, and the microphone is attached to the motor body.

10. The drive system according to claim 9, wherein the microphone is attached to the inside of the motor body.

11. An electric apparatus comprising:

a plurality of drive systems, a respective actuator included in each drive system of the plurality of drive system, each respective actuator including at least an electric motor, which includes a motor body and a rotating shaft having an external portion extending from the motor body, where a central axis of the electric motor extends coaxially along the rotating shaft, and where an exterior surface of the motor body is at a first radial distance from the central axis, a respective microphone included in each drive system of the plurality of drive system, each respective microphone operating to pick up sound emitted from the respective electric motor, where the respective microphone is located radially from the external portion of the rotating shaft at a second radial distance less than the first radial distance, and a respective sound generator included in each drive system of the plurality of drive system, each respective sound generator emitting sound in response to a signal derived from sound caught by the respective microphone.

* * * * *